US007121994B2

(12) United States Patent
Haasl

(10) Patent No.: US 7,121,994 B2
(45) Date of Patent: Oct. 17, 2006

(54) ASSEMBLY FOR AND METHOD OF ADJUSTING THE PHASING OF FOLDING ROLLS TO CREATE A FOLD IN SHEETS OF MATERIAL

(75) Inventor: Andrew L. Haasl, Green Bay, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 0 days.

(21) Appl. No.: 10/952,959

(22) Filed: Sep. 29, 2004

(65) Prior Publication Data

US 2005/0070419 A1 Mar. 31, 2005

Related U.S. Application Data

(60) Provisional application No. 60/507,377, filed on Sep. 30, 2003.

(51) Int. Cl.
*B31F 1/10* (2006.01)

(52) U.S. Cl. ..... 493/442; 493/343; 493/405; 493/411

(58) Field of Classification Search ..... 493/343, 493/405, 411, 413, 430, 433, 448, 442; 270/39.05, 270/39.06

See application file for complete search history.

(56) References Cited

U.S. PATENT DOCUMENTS 1,789,965 A * 1/1931 Christman, Jr. ..... 270/59
2,092,952 A * 9/1937 Campbell ..... 270/39.07
2,555,267 A 5/1951 Crafts
2,929,624 A * 3/1960 Brooker ..... 270/39.09
4,159,823 A 7/1979 Bryer et al.
4,176,833 A 12/1979 Heimlicher
4,254,947 A 3/1981 Trogan
4,514,819 A * 4/1985 Punater et al. ..... 702/151
4,895,356 A 1/1990 Rudolf
5,048,387 A * 9/1991 Niitsuma et al. ..... 83/344
5,057,064 A 10/1991 Michalik
5,096,174 A * 3/1992 Nishihara ..... 270/47
5,167,604 A * 12/1992 Ohsawa ..... 493/23
5,201,701 A 4/1993 Roettger et al.
5,215,014 A 6/1993 Burger et al.
5,242,367 A 9/1993 Marmin
5,405,127 A 4/1995 Welborn (Continued)

FOREIGN PATENT DOCUMENTS

EP 0922661 6/1999

(Continued)

*Primary Examiner*—Hemant M. Desai
(74) *Attorney, Agent, or Firm*—Boyle,Fredrickson, Newholm,Stein&Gratz,S.C.

(57) ABSTRACT

A folding machine includes a first folding roll with a series of the gripper assemblies and a series of tucker assemblies uniformly and alternately spaced to interact with a series of gripper and tucker assemblies of an adjacent second folding roll. The series of alternately spaced gripper and tucker assemblies interact to grip, carry, and release a sheet material in a manner so as to generate an interfolded stack of sheet material. The folding machine further includes a phase adjustment assembly configured adjust the location of the fold in the sheet material, to locate the fold in a proper position on the sheet relative to the leading end of the successive sheet. The phase adjustment assembly generally includes a first helical gear that moves along an axial direction, and an input device configured to cause the axial movement of the first gear so as to cause a change in phasing and a change in location of the fold in the sheet material.

6 Claims, 6 Drawing Sheets

U.S. PATENT DOCUMENTS

| | | | | |
|---|---|---|---|---|
| 5,507,714 | A | 4/1996 | Furuta et al. | |
| 5,522,586 | A | 6/1996 | Bennett et al. | |
| 5,571,069 | A | 11/1996 | Shah | |
| 5,676,630 | A | 10/1997 | Mayr | |
| 5,772,571 | A | 6/1998 | Marcle-Geller et al. | |
| 5,983,753 | A | 11/1999 | Kostiza | |
| 6,267,034 | B1 * | 7/2001 | Beckwith | 83/305 |
| 6,428,001 | B1 | 8/2002 | Jackson | |
| 6,689,038 | B1 * | 2/2004 | White | 493/360 |

FOREIGN PATENT DOCUMENTS

| | | |
|---|---|---|
| JP | 56099166 | 8/1981 |
| JP | 01192669 | 8/1989 |
| JP | 06255881 | 9/1994 |

* cited by examiner

FIG. 3
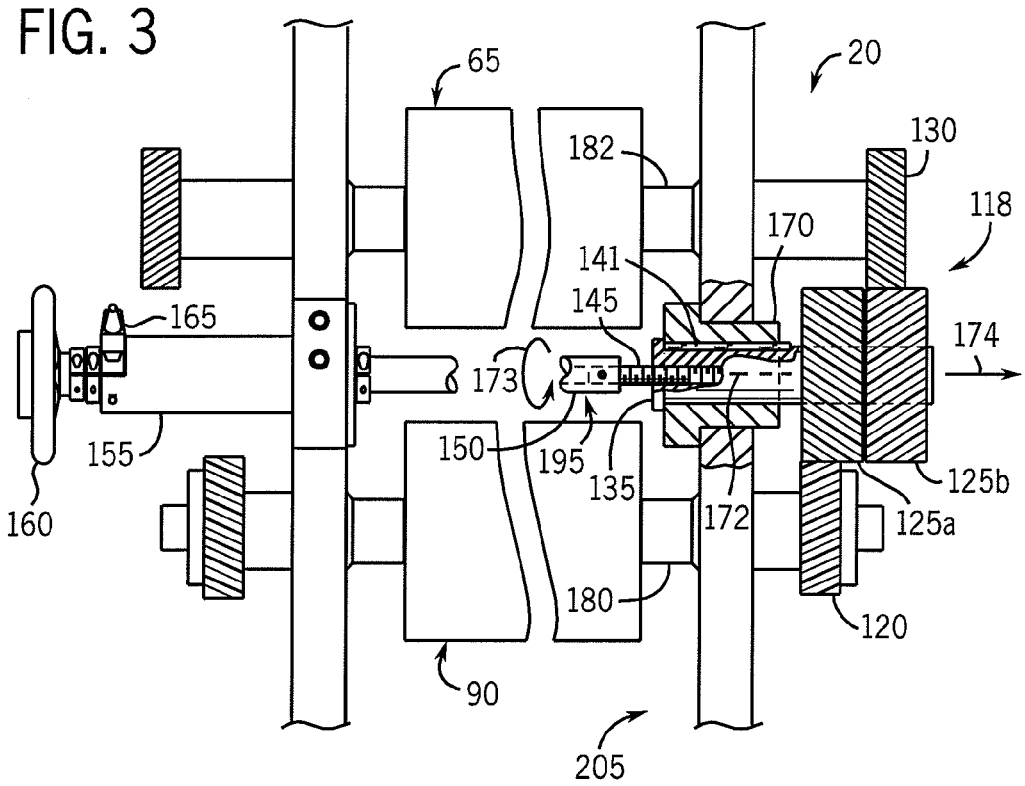
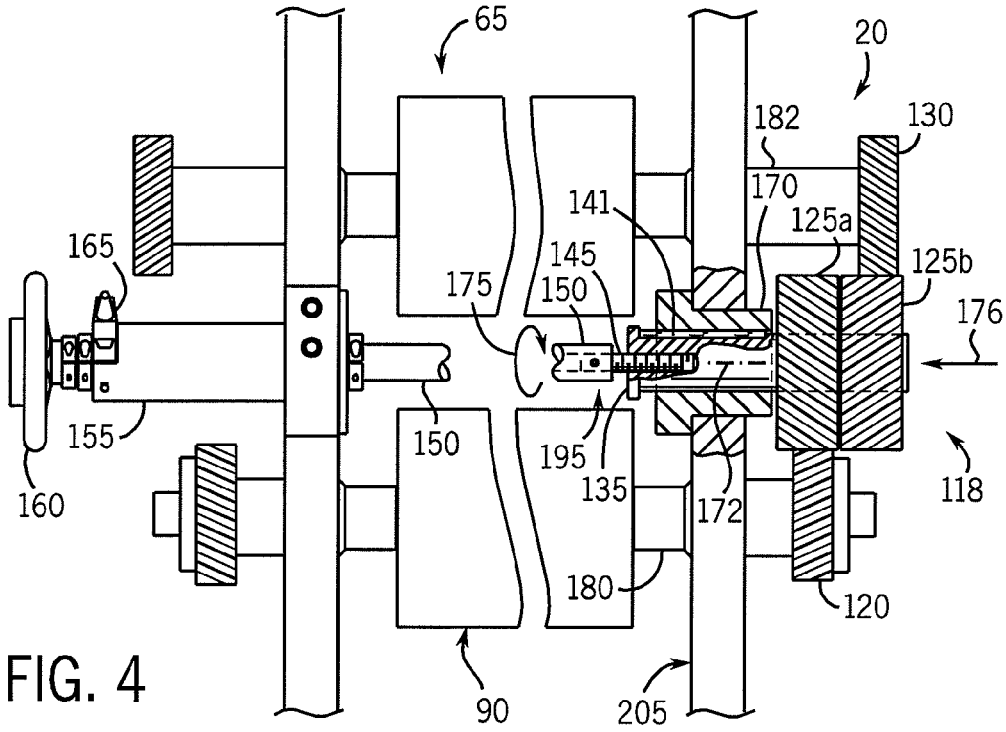
FIG. 4

ASSEMBLY FOR AND METHOD OF ADJUSTING THE PHASING OF FOLDING ROLLS TO CREATE A FOLD IN SHEETS OF MATERIAL

RELATED APPLICATIONS

This application claims the benefit under 35 U.S.C. § 119(e) of U.S. Provisional Application Ser. No. 60/507,377, filed Sep. 30, 2003, the entirety of which is hereby incorporated herein by reference.

FIELD OF THE INVENTION

This invention generally relates to an interfolding machine for interfolding sheets of material, and more specifically, to an interfolding machine that includes folding rolls having a timing assembly configured to allow adjustments in the phasing between the folding rolls while the interfolding machine is running.

BACKGROUND OF THE INVENTION

Folding of web or sheet material (e.g., paper, napkins, paper towels, tissue, etc.) is frequently performed using a pair of folding rolls that have interacting mechanical gripper and tucker assemblies. The gripper and tucker assemblies are uniformly spaced around a circumference of each respective folding roll to interact with one another so as to interfold the sheets of material. The tucker assemblies on one roll interact with the gripper assemblies of the adjacent roll, and vice versa, to alternately grip and tuck successive sheets of material fed between the rolls. As the rolls rotate, the gripper assemblies carry and release the folded sheets of material to create a zigzagged interfolded stack of sheets. The folding rolls rotate in a specified timed or phased manner to provide the desired function of folding the sheets at a desired location so as to create the zigzag interfolded stack of sheets, and to ensure that the grippers and tuckers engage the sheet and each other in a desired position. In order to adjust the timing or phasing between the rolls, the interfolding machine is stopped and an operator rotates one of the folding rolls to adjust its position relative to the other, to provide the desired phasing between the rolls.

The folding rolls of known interfolding machines are normally gear driven from a drive system that also drives other components of the machine. The phasing between the folding rolls controls the location of the fold in the sheet, as well as the position of engagement between the grippers and tuckers of the folding rolls. In order to adjust the phasing between the folding rolls, it is necessary for an operator to stop operation of the machine and to rotate one of the folding rolls by loosening bolts affixing a hub keyed to the drive input journal of the folding roll. The hub is slotted so the folding rolls can be manually rotated.

However, known folding machinery has several drawbacks. For example, known folding machinery requires that adjustments be made to the phasing of the gear drives of the folding rolls in order to provide the fold crease in the desired location on the sheet and to adjust the relative positions of the folding rolls. These phasing adjustments require the operator to shutdown the machinery, disassemble the gear drives, and make adjustments on a trial and error basis. These adjustments are costly, cumbersome and time consuming.

SUMMARY OF THE INVENTION

In accordance with the present invention, there is provided an interfolding machine configured to interfold sheet material, which generally includes a first folding roll and a second folding roll disposed adjacent the first roll. The first and second rolls are configured to provide a fold or crease in the sheet material. The folding machinery further includes an upstream roll, such as a lap roll, and a phase adjustment assembly or apparatus having a helical drive gear interconnected with the at least one of the folding rolls and the upstream roll, and an input arrangement having at least one helical input gear that is engaged with the helical drive gear. The helical input gear is operable to move along an axial direction relative to the longitudinal axes of the folding rolls. The helical drive gear is connected to the folding roll such that axial movement of the helical input gear causes an adjustment in the rotational position of the folding roll through the helical drive gear, which thereby adjusts the phasing between the folding rolls and the upstream portion of the machine where lapping and cutting of the sheets occurs, while the interfolding machine is in operation. The adjustment in the phasing of the folding rolls causes an adjustment in the relative positions of the grippers and tuckers relative to the upstream portion of the machine that supplies the sheets to the folding rolls, and thereby in the location of the fold or crease in the sheet material created by operation of the grippers and tuckers.

A first roll, which is one of the folding rolls, is preferably mounted on a first shaft and a second roll, which is an upstream roll such as a lap roll, is preferably mounted on a second shaft. A helical drive gear is connected to each of the first and second shafts. The phase adjustment assembly may include a first drive gear that is mounted to the first shaft and a second drive gear that is mounted to the second shaft. An input arrangement includes a pair of axially movable input gears that are engaged with the first and second drive gears, and an input device configured to cause axial movement of the pair of axially movable input gears. Such axial movement of the input gears alters the axial position of engagement between the input gears and the drive gears, and the helical orientation of the gear teeth causes rotation of the first and second shafts, and thereby the first and second rolls, to adjust the phasing between the first and second rolls while the machine is running.

In one form, the input device includes an adjustment actuator that includes a handwheel, and a shaft coupling the handwheel to the input gears such that adjustment of the adjustment handwheel causes axial movement of the shaft and the input gears. The input device further includes a locking device configured to secure the position of the shaft and the input gears in a desired position. The shaft includes a threaded adjustment feature that is operable to vary the position of the input gears upon rotation of the shaft.

In accordance with another aspect of the invention, an interfolding machine includes a first rotating folding roll and a second rotating folding roll configured to create a fold in a sheet moving between the rolls. The folding machine further includes one or more upstream rolls, such as a lap roll, that supply sheets to the folding rolls, and a phase adjustment assembly having a helical drive gear interconnected with one of the rolls, and an axially movable helical input gear engaged with the helical drive gear. Axial movement of the helical input gear causes rotation of the roller through the drive gear, to adjust phasing between one of the upstream rolls and the folding rolls while the machine is running, to alter the location of the fold in the sheet material.

In accordance with a further aspect of the present invention, there is provided a method of adjusting the phase of a first roll relative to a second roll of an interfolding machine configured to provide a fold in a sheet of material. The method comprises the acts of providing a first folding roll driven by a first gear, which interacts with a second folding roll to provide a fold in a sheet of material. The phasing between the first roll, which may be an upstream roll such as a lap roll, is adjusted relative to the second roll, which may be one of the folding roll, by carrying out the act of adjusting the relative positions of the rolls during operation while the rolls are rotating. The act of adjusting the relative positions of the rolls is carried out via a helical drive gear that rotates with at least one of the rolls, in combination with an axially movable helical input gear that is engaged with the helical drive gear. The act of adjusting the relative positions of the rolls is carried out by axially moving the helical input gear, such as by operation of a handwheel, which causes rotational movement of the helical drive gear and thereby rotation of the first roll relative to the second roll to shift the phasing between the first and second rolls.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout. In the drawings:

FIG. 3 is a detailed top plan view, partially in section, showing the roll phase adjustment assembly in a first position.

FIG. 4 is view similar to FIG. 2, showing the roll phase adjustment assembly in a second position to adjust the phasing between the rolls.

DETAILED DESCRIPTION OF THE PREFERRED EMBODIMENTS

1. Folding Machine

Figure 1:
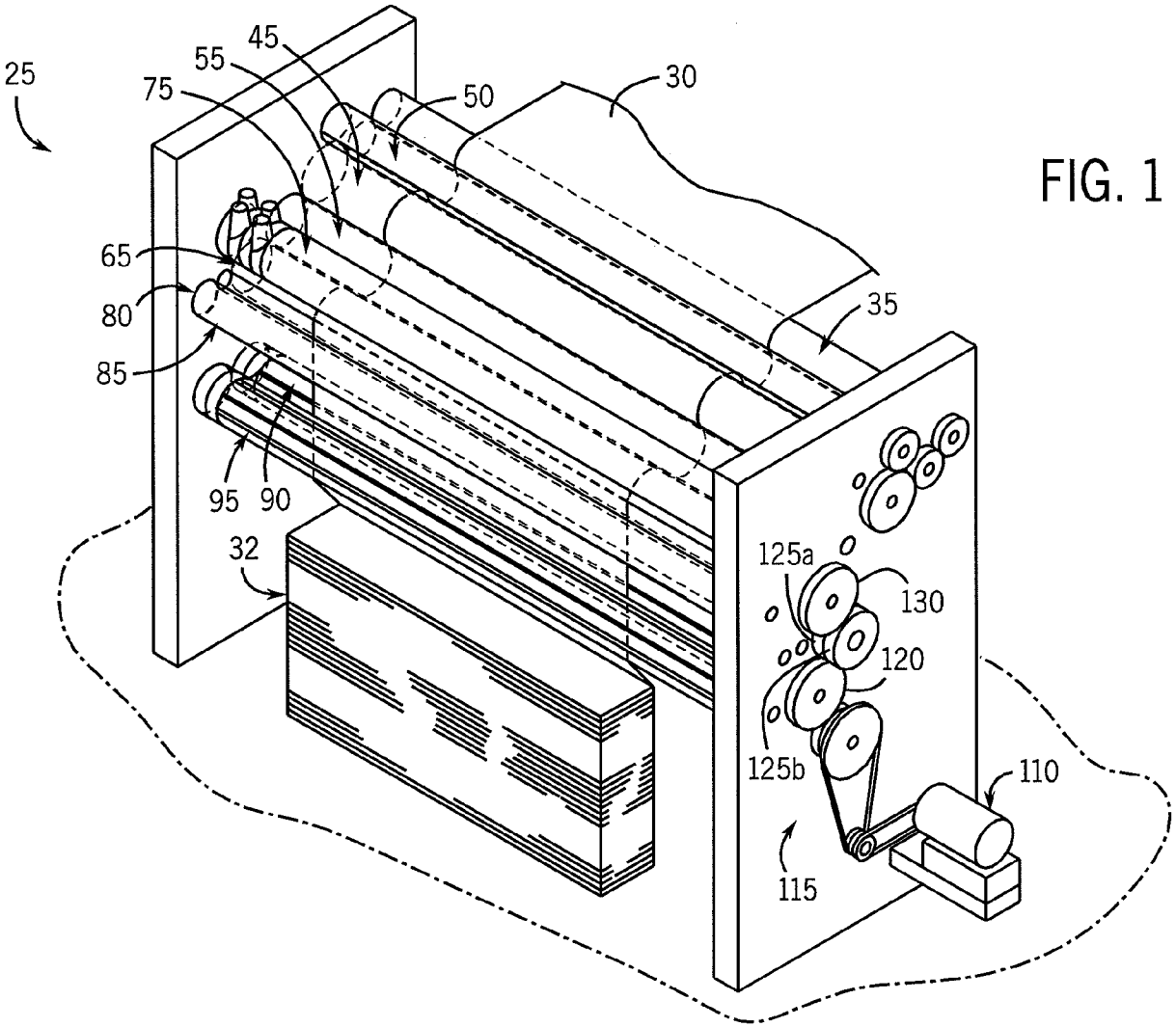
FIG. 1 is an isometric view of an interfolding machine employing a roll phase adjustment assembly in accordance with the present invention.
Figure 2:
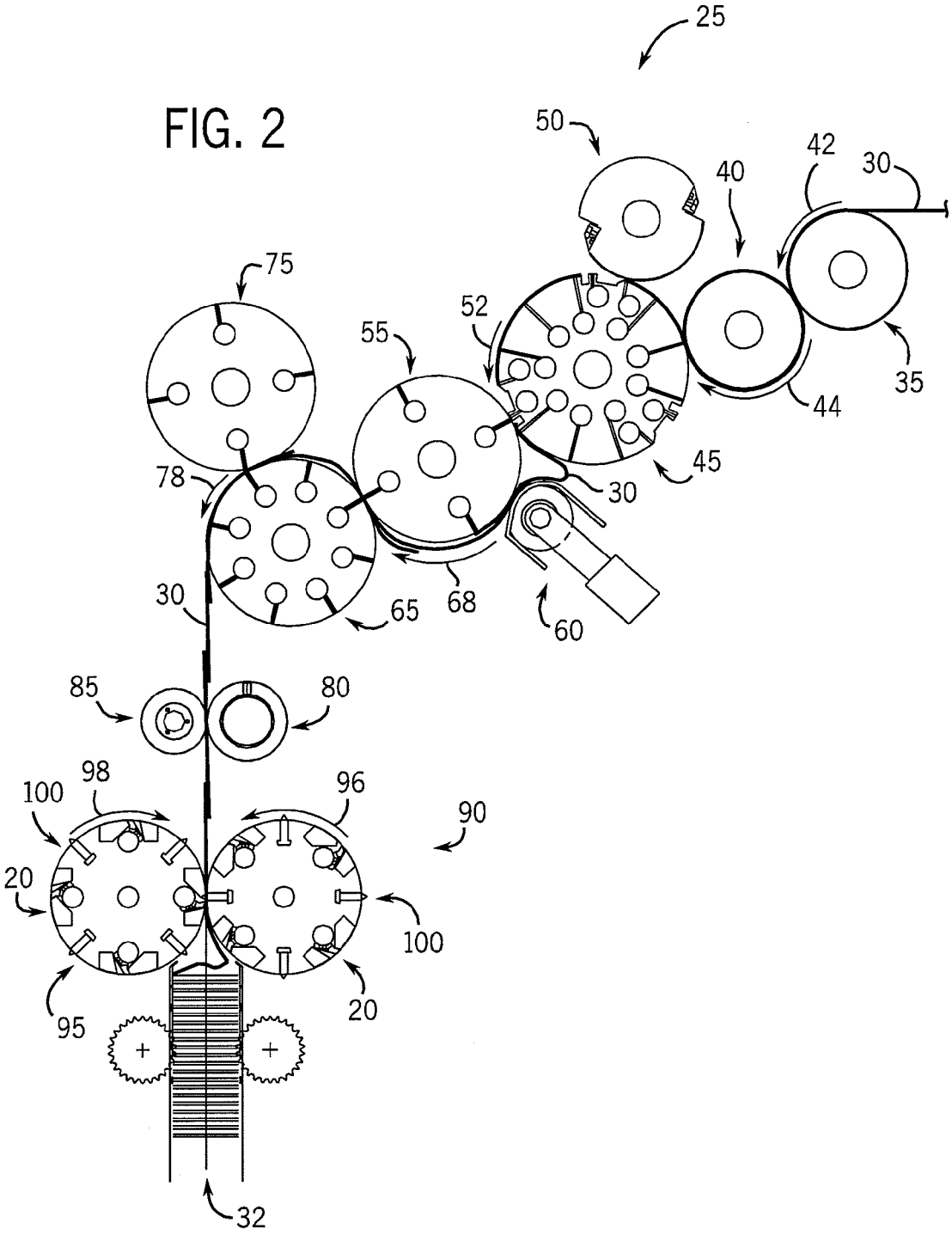
FIG. 2 is a schematic side elevation view of the interfolding machine as shown in FIG. 1.
Figure 5:
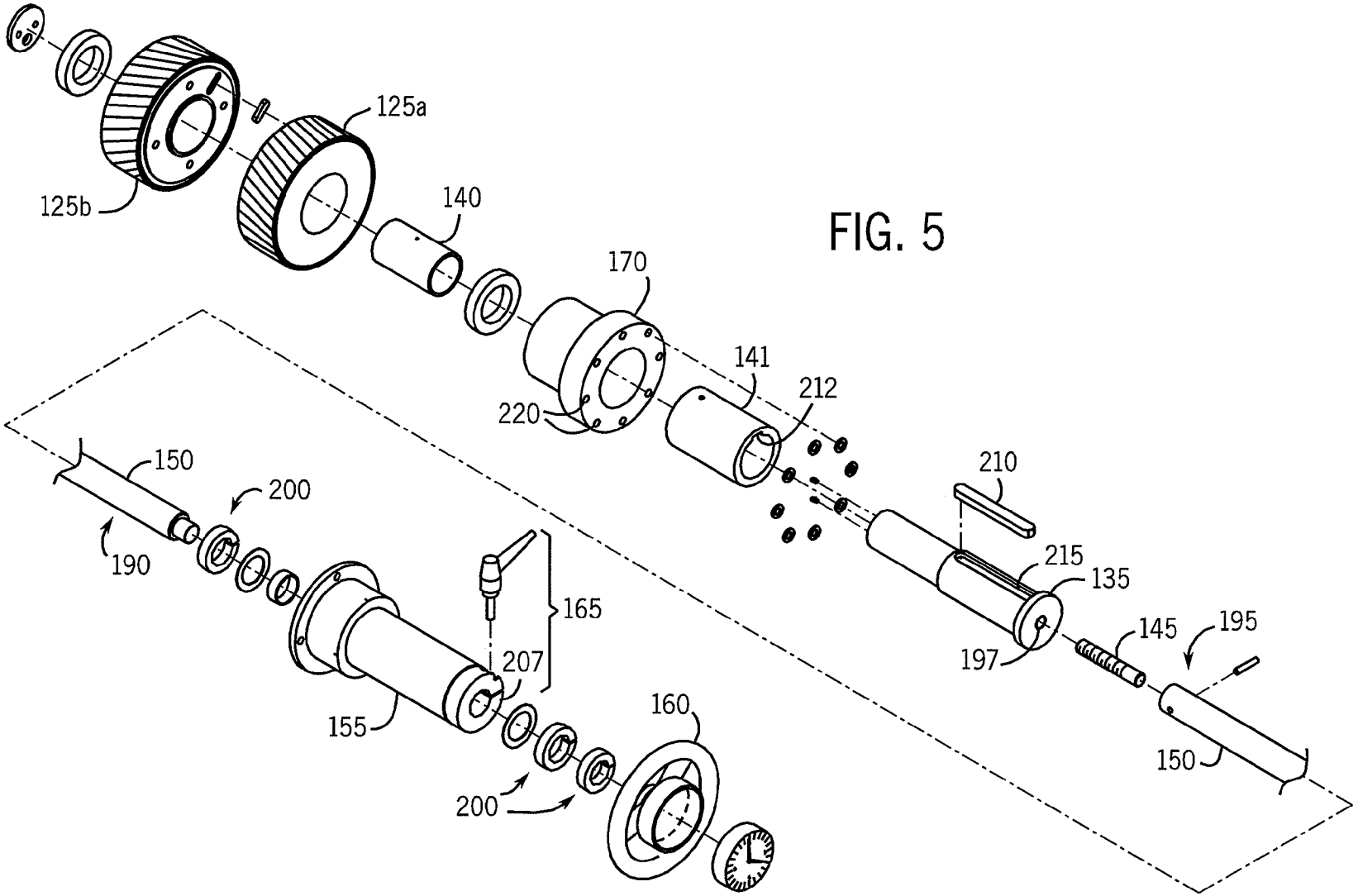
FIG. 5 is an exploded isometric view of the input or actuator assembly incorporated in the roll phase adjustment assembly or FIGS. 3 and 4.

Referring to FIGS. 1 and 2, an interfolding machine 25 is operable to convert a web of material 30 into a stack of interfolded sheets of material shown at 32. Interfolding machine 25 incorporates folding rolls incorporating the folding roll phase adjustment assembly of the present invention, and generally includes a first pull roll 35 and a second pull roll 40 that receive the web of material 30 along a path (illustrated by an arrow 42 in FIG. 2) from a supply roll (not shown) into the interfolding machine 20. The first and second pull rolls 35 and 40 define a nip through which the web of material 30 passes, and function to unwind the web of material 30 and feed the web of material 30 in a path (illustrated by an arrow 44 in FIG. 2) toward a nip defined between second pull roll 40 and a bed roll 45. The web of material 30 is then advanced by bed roll 45 toward a knife roll 50. In a manner as is known, the knife roll 50 cuts the web of material 30 into sheets, each of which has a predetermined length, and the bed roll 45 carries the sheets of material along a path (illustrated by arrow 52 in FIG. 2) toward and through a nip defined between bed roll 45 and a retard roll 55, which rotates at a slower speed of rotation than the bed roll 45. In a manner as explained in application Ser. No. 10/953,175 filed Sep. 29, 2004, the retard roll 55 cooperates with a nip roller assembly 60 (FIG. 2) to form an overlap between the consecutive sheets of material. The retard roll 55 carries the overlapped sheets of material along a path (illustrated by arrow 68 in FIG. 2) to a lap roll 65.

The lap roll 65 works in combination with a count roll 75 to eliminate the overlap between adjacent sheets of material at a predetermined sheet count, so as to create a separation in the stack 32 of interfolded sheets discharged from the interfolding machine 25. The lap roll 65 carries the overlapped sheets of sheet material 30 along a path (illustrated by arrow 78 in FIG. 2) toward a nip defined between a first assist roll 80 and an adjacent second assist roll 85. The first and second assist rolls 80 and 85 feed the sheets of sheet material 30 between a first folding roll 90 and a second folding roll 95.

Referring to FIG. 2, the first and second folding rolls 90 and 95 generally rotate in opposite directions (illustrated by arrows 96 and 98, respectively, in FIG. 2) to receive the overlapped sheets of material 30 therebetween. The periphery of the first folding roll 90 generally includes a series of the gripper assemblies 100 and a series of tucker assemblies 105 uniformly and alternately spaced to interact with a series of gripper assemblies 100 and tucker assemblies 105 of the adjacent second folding roll 95. The series of alternately spaced gripper assemblies 100 and tucker assemblies 105 of the first and second folding rolls 90 and 95 interact to grip, carry, and release the sheet material 30 in a desired manner so as to form the desired interfolded relationship in the sheets of material and to form stack 32 of interfolded sheets. The folding rolls 90 and 95 may be driven by a drive system 110 having a drive belt assembly 115 (FIG. 1).

As illustrated in FIG. 2, each of the gripper assemblies 100 is generally located at a distance from the next tucker assembly 105 along the circumference of each of the first and second folding rolls 90 and 95. The spacing between gripper assemblies 100 and tucker assemblies 105 determines the longitudinal dimension or length between the folds in the sheet material 30 as measured in a direction of travel (illustrated by arrows 96 and 98) of the first and second folding rolls 90 and 95.

The stack 32 of interfolded sheets is discharged from between the first and second folding rolls 90 and 95 in a generally vertically-aligned fashion. The stack 32 of interfolded sheets may be supplied to a discharge and transfer system (not shown), which guides and conveys the stack 32 from the generally vertically-aligned orientation at the discharge of the interfolding machine 25 to a generally horizontally-aligned movement. One embodiment of a suitable discharge and transfer system is described in U.S. Pat. No. 6,712,746 entitled "Discharge and Transfer System for Interfolded Sheets," filed May 5, 2000, the disclosure of which is hereby incorporated herein by reference in its entirety. Another representative discharge and transfer system is illustrated in application Ser. No. 10/610,458 filed Jun. 30, 2003, now U.S. Pat. No. 6,865,861, issued Mar. 15, 2005, the disclosure of which is also hereby incorporated herein by reference in its entirety.

2. Phase Adjustment Assembly

FIGS. 3 and 4 show a phase adjustment assembly 20 in accordance with the present invention, which is configured to adjust the phase of the folding roll 90 relative to the lap roll 65, which work in concert to create a fold in a downstream sheet of material 30 at the location of the leading edge of an upstream sheet of material 30. The phase adjustment assembly 20 generally includes a drive train 118 with a first split helical drive gear 120, a pair of helical input or input gears 125*a* and 125*b*, respectively, and a second split helical drive gear 130. In a manner to be explained, phase adjustment assembly further includes an input shaft 135, an input bearing 140, a bushing 141, a threaded stud 145, an actuator or adjustment shaft 150, a handwheel housing 155, a handwheel 160, a locking collar 165, and a shaft housing 170.

The adjustment shaft 150 is configured to be selectively rotated, which results in axial movement of the input shaft 135 through threaded stud 145. The pair of helical input gears 125*a* and 125*b* are mounted to the input shaft 135 via input bearings 140*a* and 140*b*, so that helical input gears 125*a* and 125*b* are rotatably supported on bearings 140*a* and 140*b*, respectively. With this construction, rotational movement of the adjustment shaft 150 (illustrated by arrow 173) causes axial movement of the helical input gears 125*a* and 125*b*.

The helical input gear 125*a* engages folding roll split helical drive gear 120, and the helical input gear 125*b* engages lap roll split helical drive gear 130. Folding roll split helical gear 120 is connected to a shaft 180 that rotatably supports the folding roll 90. Similarly, the lap roll split helical gear 130 is connected to a shaft 182 that rotatably supports the lap roll 95. Input gears 125*a*, 125*b* have a width greater that the width of split helical drive gears 120, 130, respectively, which enables axial movement of the input gears 125*a*, 125*b* relative to the drive gears 120, 130 while maintaining engagement of input gears 125*a*, 125*b* with drive gears 120, 130, respectively.

The handwheel 160 is attached or affixed to a first end 190 of the adjustment shaft 150, which is rotatably supported on the frame of interfolding machine 25 via handwheel housing 155. Suitable collars and bearings, such as 200, are interposed between adjustment shaft 150 and handwheel housing 155 to rotatably support the proximal end of adjustment shaft 150, and fix the axial position of the shaft 150. The stud 145 is secured or attached to the distal end 195 of the shaft 150, such as by a pin or other satisfactory mounting arrangement, such that stud 145 rotates along with adjustment shaft 150 during rotation of adjustment shaft 150. Stud 145 includes a threaded shank, which is engaged within a threaded passage 197 that extends inwardly from the inner end of input shaft 135. With this construction, rotation of adjustment shaft 150 causes axial movement of input shaft 135, which is mounted in the main frame 205 for movement in an axial direction (such as 174, 176) via shaft housing 170. The shaft housing 170 is fixedly attached to the main frame 205 in any satisfactory manner, such as by fasteners that extend through fastener openings such as 220. Shaft housing 155 includes a clamping section 207, which includes ends provided with aligned threaded passages within which a threaded member of a lock handle 165 is received. Clamping section is operable in response to advancement of lock handle 165 to selectively clamp adjustment shaft 150, to prevent rotation of adjustment shaft 150 relative to shaft housing 165.

A key 210 is received within a slot 215 in the input shaft 135. Key 210 is also engaged with a keyway 212 formed in an internal passage defined by bushing 141. With this construction, key 210 functions to guide axial movement of input shaft 135 relative to shaft housing 170, and prevents rotation of input shaft 135 relative to frame 205.

The end of input shaft opposite slot 215 has a reduced diameter, which is configured to fit within a passage defined by bearing 140. The helical input gears 125*a* and 125*b* are mounted on the input shaft 135 via bearing 140, so that input gears 125*a*, 125*b* are rotatable on input shaft 135. In this manner input gears 125*a*, 125*b* function to transfer rotary power between roller shafts 180, 182 in response to operation of drive system 110. With this arrangement, axial movement of the helical input gears 125*a* and 125*b* along the axial direction (such as 172, 174) functions to impart relative rotation between the folding roll split helical drive gears 120 and 130, due to the helical configuration of the mating teeth of input gears 125*a*, 125*b* and drive gears 120, 130, respectively. Such adjustment of the rotational positions of helical drive gears 120 and 130 adjusts the phasing between the folding rolls 90 and 95 relative to the lap roll 65.

Figure 6:
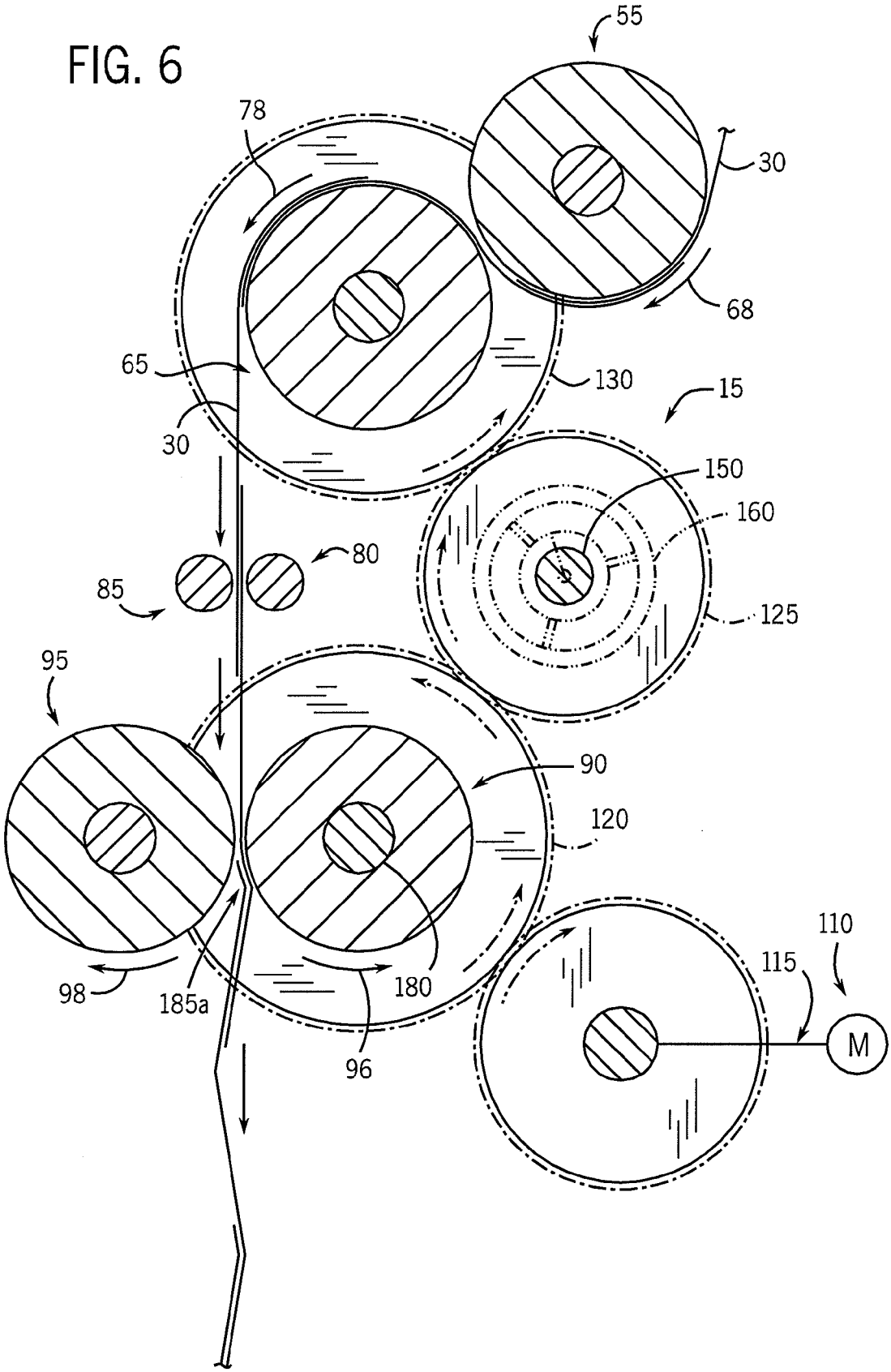
FIG. 6 is a detailed schematic diagram similar to FIG. 2, showing operation of the folding rolls to form a fold or crease in a sheet of material at a first position.
Figure 7:
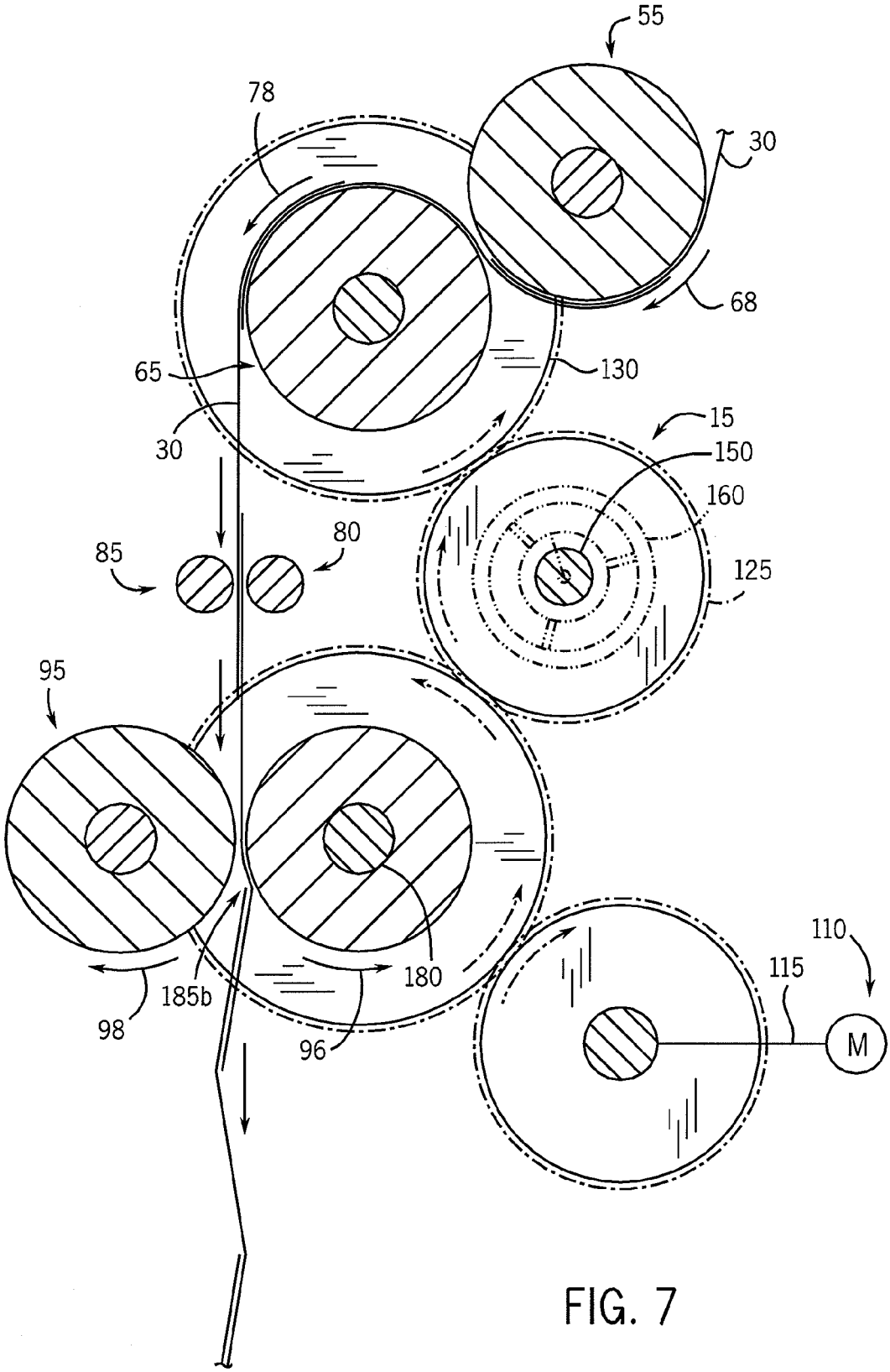
FIG. 7 is a detailed schematic diagram similar to FIGS. 2 and 6, showing adjustment in the position of the fold or crease in the sheet of material using the roll phase adjustment assembly of present invention.

In operation, when it is desired to adjust the phase between the folding rolls 90, 95 and the lap roll 65, the operator loosens handle 165 to unlock clamping section 207. The operator then can rotate handwheel 160 to impart rotation to adjustment shaft 150, which causes inward or outward translation of input shaft 135 relative to frame 205, due to the threaded connection between input shaft 135 and stud 145. Such inward and outward movement of input shaft 135 causes axial inward and outward movement of input gears 125*a*, 125*b*, which results in adjustment in the relative rotational position between folding roll 90 and lap roll 65. This adjustment can occur during operation, such that input gears 125*a*, 125*b* continuously rotate to transfer rotary power between drive gears 120, 130 during such axial inward or outward movement of input gears 125*a*, 125*b*. In this manner, the location of the fold on the sheets 30 can be adjusted, e.g. to alter or correct the undesirable fold condition shown at 185*a* in FIG. 6 and to attain a desired fold condition as shown at 185*b* in FIG. 7. When the desired phasing between rolls 90, 95 relative to lap roll 65 is attained, the user re-tightens handle 165 to clamp adjustment shaft 150 against rotation, to maintain the desired relative rotational positions of folding rolls 90, 95 relative to the lap roll 65.

A wide variety of machines or systems could be constructed in accordance with the invention defined by the claims. Hence, although the exemplary embodiment of a phasing assembly or phase adjustment assembly 20 in accordance with the invention will be generally described with reference to an interfolding machine 25 for folding sheet material 30 into an interfolded, zig-zag stack 32, the application of the phase adjustment assembly 20 can be applied to adjust phasing or timing of a wide variety of machines while in operation and is not limiting on the invention. In addition, it is understood that phase adjustment between the rolls can also be accomplished using a single helical input gear and a single helical drive gear, to alter the rotational position of only a single one of the folding rolls.

The above discussion, examples, and embodiments illustrate our current understanding of the invention. However, since many variations of the invention can be made without departing from the spirit and scope of the invention, the invention resides wholly in the claims hereafter appended.

I claim:

1. An interfolding machine, comprising;

an upstream roll mounted for rotation with a first shaft;

first and second folding rolls configured to create a fold in each of a pair of successively fed overlapping sheets, wherein one of the folding rolls is mounted for rotation with a second shaft, wherein the first and second folding rolls are configured to create an alternating oppositely directed fold in each of the pair of successively fed overlapping sheets;

a first helical gear secured to the first shaft;

a second helical gear secured to the second shaft; and phase adjustment device configured to cause rotational movement of the first shaft through the first gear and the second shaft through the second gear to adjust the position at which a fold is formed in one of the sheets, wherein the phase adjustment device includes an oppositely oriented helical gear arrangement mounted on an axially movable input shaft, wherein axial movement of the input shaft causes rotational movement of the first and second gears through the helical gear arrangement to change the phasing of the upstream roll relative to the folding rolls during operation of the interfolding machine.

2. The interfolding machine as recited in claim 1, wherein the input device includes:

a rotatable adjustment actuator; and an adjustment shaft coupled to the adjustment actuator, wherein rotation of the adjustment actuator causes rotation of the adjustment shaft, and wherein the rotational movement of the adjustment shaft causes axial movement of the input shaft.

3. The interfolding machine as recited in claim 2, wherein the input device further includes:

a locking device configured to secure the position of the adjustment shaft thereby the first gear.

4. The interfolding machine as recited in claim 2, wherein the adjustment actuator is interconnected with the input shaft via a threaded connection that causes axial movement of the input shaft upon rotation of the adjustment actuator.

5. A method of adjusting an interfolding machine, the method comprising the steps of:

providing an interfolding machine including an upstream roll mounted for rotation with a first shaft, and first and second folding rolls configured to create a fold in a sheet, wherein one of the folding rolls is mounted for rotation with a second shaft, wherein the upstream roll is configured to supply successive overlapping sheets to the folding rolls and wherein the folding rolls are configured to create an alternating oppositely directed fold in each of a pair of successively fed overlapping sheets, wherein a first helical gear is secured to the first shaft and a second helical gear is secured to the second shaft; and adjusting the phasing between the upstream roll and one of the folding rolls to alter the location of a fold in a sheet relative to an edge of an overlapping sheet by causing relative rotational movement of the first shaft through the first gear and the second shaft through the second gear, wherein the relative rotation between the first shaft and the second shaft is caused by axially moving an oppositely oriented helical gear arrangement engaged with the first and second helical gears by axial movement of an input shaft, wherein axial movement of the input shaft and the oppositely oriented helical gear arrangement causes rotational movement of the first and second helical gears through engagement of the helical gear arrangement with the first and second helical gears to alter the phasing of the upstream roll relative to one of the folding rolls during operation of the interfolding machine.

6. The method as recited in claim 5, wherein the step of axially moving the input shaft is carried out by operation of a rotatable adjustment actuator and an adjustment shaft coupled to the adjustment actuator, wherein rotation of the adjustment actuator causes rotation of the adjustment shaft, and wherein the rotational movement of the adjustment shaft causes axial movement of the input shaft.

* * * * *